US005334324A

United States Patent [19]

Zeise et al.

[11] Patent Number: 5,334,324

[45] Date of Patent: Aug. 2, 1994

[54] BLEACH ACTIVATORS IN GRANULAR FORM

[75] Inventors: Christiane Zeise, Korschenbroich; Jochen Jacobs, Wuppertal; Wilfried Raehse, Duesseldorf, all of Fed. Rep. of Germany

[73] Assignee: Henkel Kommanditgesellschaft auf Aktien, Fed. Rep. of Germany

[21] Appl. No.: 978,700

[22] PCT Filed: Jul. 25, 1991

[86] PCT No.: PCT/EP91/01393

§ 371 Date: Feb. 3, 1993

§ 102(e) Date: Feb. 3, 1993

[87] PCT Pub. No.: WO92/02608

PCT Pub. Date: Feb. 20, 1992

[30] Foreign Application Priority Data

Aug. 3, 1990 [DE] Fed. Rep. of Germany ..... 4024759

[51] Int. Cl.[5] ..... C11D 1/831; C11D 3/395; D06L 3/02; D06L 3/16

[52] U.S. Cl. ..... 252/91; 252/95; 252/174; 252/174.13; 252/182.12; 252/182.23; 252/182.28; 252/182.29; 252/186.25; 252/186.26; 252/186.31; 252/186.38

[58] Field of Search ..... 252/91, 95, 174, 186.25, 252/186.26, 186.31, 186.38, 182.12, 182.23, 182.28, 182.29, 174.13

[56] References Cited

U.S. PATENT DOCUMENTS

| | | | |
|---|---|---|---|
| 4,290,903 | 9/1981 | Macglip | 252/91 |
| 4,372,868 | 2/1983 | Saran | 252/102 |
| 4,399,049 | 8/1983 | Gray | 252/91 |
| 4,486,327 | 12/1984 | Murphy et al. | 252/94 |
| 4,678,594 | 7/1987 | Parfomak et al. | 252/186.31 |
| 4,921,631 | 5/1990 | Gradwell | 252/95 |
| 4,988,451 | 1/1991 | Nunn | 252/95 |
| 4,997,590 | 3/1991 | Bowling | 252/186.31 |
| 5,002,691 | 3/1991 | Bolkan | 252/186.25 |

FOREIGN PATENT DOCUMENTS

| | | |
|---|---|---|
| 0006655 | 1/1980 | European Pat. Off. . |
| 0037026 | 10/1981 | European Pat. Off. . |
| 0075818 | 4/1983 | European Pat. Off. . |
| 0098021 | 1/1984 | European Pat. Off. . |
| 0106634 | 4/1984 | European Pat. Off. . |
| 0373743 | 6/1990 | European Pat. Off. . |
| 3011998 | 10/1981 | Fed. Rep. of Germany . |
| 3807920 | 9/1989 | Fed. Rep. of Germany . |
| 3807921 | 9/1989 | Fed. Rep. of Germany . |
| 3816842 | 11/1989 | Fed. Rep. of Germany . |

*Primary Examiner*—Dennis Albrecht

*Attorney, Agent, or Firm*—Ernest G. Szoke; Wayne C. Jaeschke; Real J. Grandmaison

[57] ABSTRACT

A process for preparing free-flowing granules containing a bleach activator and a substantially water-free binder for the bleach activator. The process consists essentially of premixing a mixture of anionic and nonionic surfactants and the bleach activator, homogenizing the resulting mixture to form a paste which is extrudable in strand form, extruding the paste under elevated pressure, and cutting the extrudate into granules.

20 Claims, No Drawings

BLEACH ACTIVATORS IN GRANULAR FORM

BACKGROUND OF THE INVENTION

Field of the Invention

This invention relates to new pourable and free-flowing granules containing bleach activators for washing laundry in a binder phase as their principal constituent, the binder phase predominantly containing surfactants which are solid at room temperatures and moderately elevated temperatures, for example up to about 40° C. The invention also relates to a process for the production of the new bleach activator granules.

Inorganic peroxy compounds which dissolve in water with release of hydrogen peroxide, such as sodium perborate and sodium peroxycarbonate, have long been used as oxidizing agents for disinfection and bleaching purposes. The oxidizing effect of these substances in dilute solutions is governed to a large extent by temperature. Thus, with perborate in alkaline bleach liquors, sufficiently rapid bleaching of soiled textiles is only achieved at temperatures above 60° C. At lower temperatures, the oxidizing effect of the inorganic per compounds can be improved by addition of activators for which numerous proposals have been published in the literature. The addition of these activators can increase the bleaching effect of aqueous peroxide solutions to such an extent that they are active at temperatures of only 30° to 60° C., i.e. at the temperatures required for the washing of delicate fabrics.

However, these activators, for example from the class of N- and O-acyl compounds, are highly sensitive to hydrolysis, above all in the presence of the alkaline ingredients typically used in detergents. The resulting problems for the stability of the laundry detergents in storage are aggravated by the fact that the activators are often poorly soluble in water so that very fine-particle materials with rapid dispersibility should be used. However, this fineparticle form promotes greater hydrolysis of the activators in storage on account of the increased surface.

Discussion of Related Art

In practice, the situation is remedied by adding the bleach activator to the dry detergent mixtures in the form of separately produced granules, the agglomerates of fine bleach particles being coated with auxiliaries. Various organic and inorganic substances have been proposed as granulation aids and coating materials for such activator granules. More particularly, the use of surfactant compounds solid at room temperature from the classes of anionic, cationic and/or nonionic surfactants, polymeric materials or waxes is well known. Thus, European patent application EP 37 026 (Henkel) describes the production of pourable, uniformly coated bleach activator granules containing more than 90% active substance. In this process, 90 to 98% by weight of a powder-form bleach activator from the class of N-acylated amines, amides, diketopiperazines and glycolurils are mixed with 10 to 2% by weight of a powder-form granulation aid. The dry premix is then moistened with an aqueous solution of the granulation aid, after which the mixture is granulated. The moist granules are then dried to low residual water contents. The granulation aids used are, in particular, water-soluble cellulose ethers, water-soluble starch or water-soluble starch ethers.

Referring first to the prior art, European patent application EP 6 655 (P & G) describes the use of organic solids melting at 30° to 60° C. as agglomeration aids for the production of bleach activator granules and then discusses in detail the use of nonionic surfactant compounds from the class of linear or branched $C_{10-24}$ fatty alcohol ethoxylates, the class of $C_{8-18}$ alkylphenol ethoxylates or polyethylene glycols having relative molecular weights above 4000 as granulation aids. The alcohol ethoxylates are compounds which are solid under normal conditions and contain at least 15 EO groups per mol alcohol, the use of corresponding components containing approximately 20 EO groups being preferred. These solid nonionic surfactants may be used together with liquid or paste-form nonionics having a relatively low degree of ethoxylation. The granule mixture is said in particular to contain 30 to 50% by weight activator to 50 to 70% by weight of the nonionic compound(s). The mixture is prepared by melting of the nonionic compound, incorporation of the fine-particle activator and subsequent extrusion to a spherical mass from which spherical particles can ultimately be obtained. Powder-form organic or inorganic mixing components, such as urea, polymer compounds, silica, talcum, smectite clays, fine-particle zeolites or inorganic water-soluble salts, may be used.

According to European patent application EP 106 634 (P & G), mixtures of anionic surfactants, for example fatty acids, together with nonionic surfactants are used as granulation aids for binding the fine-particle activator components. It is pointed out with regard to the mixtures in question that comparatively small quantities of the binder are sufficient to provide the granules with the required combination of properties, namely stability in storage, strength and, at the same time, rapid dissolution in practical application. It is stated that the anionic surfactants used as fatty acids presumably reduce the hygroscopic effect of the nonionic binder while, on the other hand, the nonionic binder improves the dispersibility of the fatty acids or the other anionic surfactants. Three different methods of forming activator granules using these binder mixtures are investigated, the highest degree of retention of bleaching activity being achieved by extrusion and subsequent granulation. Activator/surfactant mixtures to which considerable quantities of water have been added to establish a state of plastic processability are used throughout as the multicomponent mixture to be extruded. Accordingly, the granules initially formed have to be subjected to a drying treatment to remove the added water.

European patent application EP 75 818 (BASF) is concerned with granulation processes in which the bleach activator granules are prepared using water as one of the auxiliaries. It has been found that, even after drying, the corresponding activator granules are comparatively sensitive to temperature and hydrolysis — obviously as a result of the added water. A small quantity of the water used as a granulation aid always remains behind in the granules and immediately destroys part of the stabilization which the granulation process is intended to provide. According to the disclosure of this patent application, the formulation of bleach activators pursues two objectives. Firstly, there is a need to improve the hydrolysis stability of the activators which, irrespective of the chemical individual, all have a readily saponifiable active group which has to be protected during storage in the alkaline washing powder. Secondly, any suitable method for protecting the bleach activator from its surroundings must allow rapid dispersion of the activator in the wash liquor. The teaching of this patent application addresses the problem of providing — without water and without using readily water-soluble highly hydratable compounds — activator granules which have a small inner surface, from which no residual water has to be evaporated and which, nevertheless, can be spontaneously dispersed in the wash liquor and achieve distinctly better stability in storage. To solve this problem, it is proposed to process the bleach activators with small quantities of a water-swellable auxiliary by dry compacting between two rollers without using water. It is specifically pointed out that the conventional methods of pelletizing and roll-up granulation are unsuccessful. The dry mixture is compressed in the gap between the rollers and the sheet formed is size-reduced.

Finally, European patent application EP 373 743 (Clorox) proposes using for granulation organic binders which have melting points above about 40° C. and, more particularly, above about 50° C. and which do not react with the activators or any other auxiliaries used. Surfactant compounds from the classes of nonionic, anionic and cationic surfactants are mentioned along with film-forming polymers, selected relatively long-chain aliphatic alcohols, comparatively low molecular weight polyethylene glycols, starch, starch ethers and carboxymethyl cellulose and many other auxiliaries of synthetic and/or natural origin. For granulation, the auxiliaries are processed in the presence of water to a paste-like consistency. After incorporation of the activator, the dough-like mass formed is extruded, dried in noodle form and subsequently reduced to granules. The water required as plasticizing agent or solvent may be added as external water, although it is also possible to introduce the water required into the process at least partly through the auxiliaries to be used, for example in the form of an aqueous anionic surfactant paste. Accordingly, the process described in this document for the formation of granules from the fine-particle bleach activators reintroduces the problem with which EP 75 818 cited above was concerned and, to solve that problem, proposes forming anhydrous mixtures in the gap between rollers with subsequent size-reduction of the compressed material.

The problem addressed by the present invention was to provide granules of fine-particle activators without having to use water as a temporary liquid phase. The stability of the granules in storage would be guaranteed, even without intermediate drying and in admixture with typical detergent ingredients, although at the same time the rapid dispersion of the bleach activator granules in the detergent solution would be ensured in practical application.

Description of the Invention

Other than in the operating examples, or where otherwise indicated, all numbers expressing quantities of ingredients or reaction conditions used herein are to be understood as modified in all instances by the term "about".

In a first embodiment, therefore, the present invention relates to pourable and free-flowing granules containing bleach activators for the washing of laundry and a substantially water-free binder phase of a mixture of anionic and nonionic surfactant compounds, the binder phase consisting predominantly of substances which are solid under typical storage conditions. It is crucial to the teaching according to the invention that the binder phase should consist of a homogenized mixture of surfactant compounds of which the components are at least partly liquid or at least plasticized at the granulation temperature and are adapted to one another in their respective quantities so that the binder phase is liquid or soft and plastic, even without water, at the working granulation temperature.

In another embodiment, the present invention relates to a process for the production of the bleach activator granules which is characterized in that the fine-particle bleach activators are mixed with the surfactant components, the resulting mixture is homogenized at preferably moderately elevated temperatures to form a paste extrudable in strand form and the paste thus formed is extruded in strand form under elevated pressures, the issuing strands are cut into granules and optionally rounded under process conditions which prevent the freshly extruded material from sticking.

In one particularly important aspect, the teaching of the invention is characterized by the choice and co-use of washing-active surfactant components which are capable of performing a binder function during the homogenization step and which ensure the processability of the mixture in an extrusion process, effectively protect the granules formed and the fine-particle activator encapsulated by the binder against unwanted interaction with moisture and other detergent ingredients, but at the same time ultimately ensure the rapid dispersion of the grain structure in the aqueous liquor.

A preferred embodiment of the invention is characterized by the use of a binder phase which is solid at room temperature and which consists of a mixture of washing-active surfactants of which the components are partly solid at the typically elevated granulation temperature and, for the rest, are liquid or at least soft and paste-like. It may be preferable to use surface-active liquid components or surfactant components which soften into a paste at the working granulation temperature and which show the corresponding rheological behavior, even at room temperature, i.e. are again present as a liquid phase or as a plasticized paste-like phase.

The homogenized mixture of solid surfactants and liquid or plastic surfactant components should retain its preferably solid and also non-tacky structure not only at room temperature, but also at the moderately elevated temperatures encountered in the practical handling of the active substances or mixtures in question. In practice, this means that the surfactant mixture preferably used as binder should have the character of a solid up to upper temperature limits of about 35° to 40° C. Granulation takes place at higher temperatures, although upper temperature limits are rapidly reached in this case, too, on account of the well-known temperature sensitivity of bleach activators. In general, the working granulation temperature does not exceed 90° C., preferably 80° C. Working granulation temperatures in the range from about 45° to 70° C. can be particularly suitable. The working granulation temperature is the temperature which can be externally adjusted by heating or cooling. By contrast, the granulation temperature is the temperature at which the granules are actually formed. Hitherto, this temperature has not been measured for reasons associated with machine construction. Accordingly, the temperatures mentioned in connection with granulation are always working temperatures. It may be assumed that, under the particular process conditions prevailing, the granulation temperature is generally above the working temperature and is only identical with the working temperature in exceptional cases.

Accordingly, the teaching according to the invention proposes using binders based on surfactants and, more particularly, on mixtures of anionic and nonionic surfactants, preferably mixtures which are solid up to 40° C., but which — as a softening and plasticizing component in the higher permitted temperature range up to 90° C. — enable the mixture to be homogenized and the surfactant mixture to be thoroughly distributed in the activator mixture with simultaneous coating of the individual bleach activator particles. The mixture which is plasticized at these elevated working temperatures is preferably extruded in strand-form and cut into granules by methods known per se. All that now remains is to cool at least the outer surface of the granules sufficiently quickly to prevent them from adhering o to one another. There is no longer any need for drying in the conventional sense to remove water because the granules only contain small negligible quantities of water which is introduced by the raw materials used, but preferably no additional water which would be necessary as an auxiliary granulation liquid. However, it can be of advantage for another reason additionally to introduce water in quantities of up to 1% by weight, based on the bleach activator granules. This reason will be discussed in more detail hereinafter. Apart from this preferred variant described o hereinafter, the process is preferably carried out with no addition of water. The desired optimal protective function of the binder is directly developed in the granules. In a preferred embodiment of the invention, the anionic surfactant component may be selected as the larger component of the surfactant mixture. In this case, it is particularly preferred to use corresponding anionic surfactant compounds which are solid at room temperature and at the working granulation temperature and which may make up at least 55% by weight and up to 98% by weight of the surfactant mixture forming the binder. The anionic surfactant content of these anionic surfactants solid at room temperature and at the working temperature is best in the range from 60 to 95% by weight and more particularly in the range from 60 to 85% by weight, based on the weight of the surfactant mixture.

Suitable solid anionic surfactants are the solid components known in detergent technology, more particularly in the context of laundry detergents, which belong in particular to the following classes: alkyl sulfates, alkyl sulfonates, alkylaryl sulfonates, sulfonated fatty acid esters and/or soaps. Particularly suitable anionic surfactants are, for example, $C_{12-18}$ fatty alcohol sulfates which may be present individually or in admixture, such as lauryl sulfate, myristyl sulfate and, more particularly, $C_{16-18}$ tallow alcohol sulfate. Other suitable special anionic surfactant components are $C_{9-13}$ alkylbenzene sulfonates (ABS), more particularly $C_{12}$ alkylbenzene sulfonate, washing-active salts of $\alpha$-sulfonated fatty acid methyl esters and/or sodium soaps of fatty acids, more particularly $C_{12-20}$ fatty acids. In this case, too, the plasticizability of the binder mixture at the elevated working temperatures can be influenced by the co-use of unsaturated components and/or by the use of potassium soaps.

Particularly suitable liquid surfactant mixture components for formulating the surfactant mixture acting as plasticizing agent and also as binder in accordance with the invention are nonionic surfactant fatty alcohol ethoxylates, i.e. preferably corresponding compounds based on $C_{12-18}$ fatty alcohols. In important embodiments, the average degree of ethoxylation does not exceed, or does not significantly exceed, a value of 10, corresponding nonionic surfactants having lower degrees of ethoxylation being preferred. It is known that nonionic surfactants of the type in question are mixtures both in regard to their fatty alcohol base and in regard to the degree of ethoxylation, the rheology or rather the dependence on temperature of the rheology of these mixtures being variable through the choice of the mixtures. A preferred limit to the average EO value is 7, corresponding compounds fluid even at room temperature with EO values of about 3 to 5 being particularly preferred.

The most important embodiment of the invention is characterized by the use of anionic surfactant/nonionic surfactant mixtures which are highly effective plasticizers at the working granulation temperature so that the desired plasticized consistency of the activator mixture can be established with only limited quantities of the surface-active binder. In this embodiment, the surfactants are present in quantities of preferably less than about 50% by weight, based on the mixture as a whole, while the bleach activator is preferably present in the mixture as a whole in quantities of from about 70 to 95% by weight. The remainder of each granule is formed by the surface-active binder or at least to a substantial extent by the surface-active binder. In important embodiments, the granules contain at least about 3% by weight and preferably at least about 5% by weight of the surface-active binder or binder mixture, quantities of the surface-active binder phase of from about 7 to 20% by weight being particularly preferred.

The free-flowing, substantially water-free compactates directly accumulating in the process may contain as fine-particle bleach activators any of the substances or mixtures of substances presently known for this purpose. In the interests of completeness, the substances in question are summarized once more as follows: suitable bleach activators for per compounds are O- and/or N-acylated compounds, such as pentaacetyl glucose (PAG), pentapropionyl glucose (PPG), tetraacetyl ethylenediamine (TAED), tetraacetyl glycoluril (TAGU), triacetyl ethanolamine (TAEA), acylated triazine derivatives, such as 1,5-diacetyl-2,4-dioxohexahydro-1,3,5-triazine (DADHT) or 1,3,5-tris-(dimethylaminopropyl)-perhydro-1,3,5-triazine, carboxylic anhydrides, such as succinic, benzoic or phthalic anhydride, salts of mixed anhydrides, such as sodium or magnesium diacetyl phosphate (NADAP or MGDAP), phenol esters, such as p-carboxyphenyl acetate, p-sulfonyl phenyl acetate, p-cresyl acetate or phenyl acetate and other phenol esters present with an anionic substituent at the phenyl group. In addition to the above-cited publications concerned with corresponding bleach activators, the following relevant publications are also mentioned: DE 30 11 998, 38 07 920 and 38 07 921 and EP 98 021. In the context of the invention, fine-particle bleach activators are understood to be activator particles of which the maximum particle size is generally not above 500 $\mu$m and preferably not above 350 $\mu$m (Helos particle size analysis). A particularly advantageous distribution is one in which at least 90% of the particles have a size of at most 250 $\mu$m and, more particularly, in the range from 50 to 200 $\mu$m.

In one particular embodiment, the process according to the invention for the production of the bleach activator granules is characterized in that the multicomponent mixture is first homogenized in a suitable mixer either at room temperature or at only moderately elevated temperatures. Suitable mixers are any of the machines typically used for this purpose, for example of the Lödige plowshare mixer type. This premix is then homogenized and processed in strand-like form. Although, basically, any type of extruder, for example linear screw extruders, may be used for this purpose, the choice of a processing machine has proved to particularly suitable for carrying out the process according to the invention. The machine in question is a strand-form pellet press. It can be of advantage in this regard to use corresponding machines with a temperaturecontrolled pressure roller of the type described in detail in DE 38 16 842. By means of this temperature-controlled pressure roller, the temperature in the working zone of the pellet press can be adjusted to predetermined values, the above-mentioned working temperature range of up to at most 90° C. and preferably from 45° to 70° C. being selected.

If necessary, the granules are subjected to shockcooling. Cooled air may be used as the cooling medium for this purpose. In addition or alternatively, the initially extruded and cut granules may be surface-treated with fineparticle solids, of which examples are powder-form zeolites, more particularly zeolite NaA of detergent quality, talcum, silica and the like.

It may be desirable and/or appropriate to incorporate other auxiliaries in the granules in addition to the bleach activators and the surface-active binder or binder mixture. These other auxiliaries preferably make up no more than 10% by weight of the granules. Suitable other auxiliaries are, for example, dyes which are known to the expert on detergents. It may be useful to suspend or dissolve these components in the liquid surfactant component before it is incorporated in the premix. Preferred dyes are pigment dyes, such as copper phthalocyanine dyes. To enhance the coloring effect of the pigments, water is added to the liquid surfactant component in quantities of up to at most 1% by weight and preferably 0.1 to 0.5% by weight, based on the bleach activator granules according to the invention. However, other auxiliaries, for example disintegrating agents, water-soluble salts and the like may also be used in order to bring out certain properties of the final granules. The prior art literature cited at the beginning may be consulted in this regard as to the type of bleach activator granules in question here.

In the extrusion of the multicomponent mixture heated to the working temperature, compression ratios may be established to provide the final granules with apparent densities of at least 500 g/l. Apparent densities of up to 1000 g/l are suitable, apparent densities in the range from 600 to 900 g/l being particularly preferred. Depending on the properties of the mixture, virtually any desired density range may be specifically established in the granules through the choice of the predetermined extrusion pressures and other processing conditions.

The granules produced in accordance with the invention are preferably cylindrical or spherical in shape. Additional rounding may usefully be carried out immediately after cutting of the strands, i.e. before the granules have completely cooled and are still sufficiently warm. Machines suitable for rounding are known and include, for example, the Marumerizers used for this purpose.

The particle size of the granules is controlled in known manner and is best adjusted to values in the range from 0.7 to 3 mm. For example, the granules can be formed in the required length of 0.7 to 3 mm or longer, for example in a length of 5 mm. The cylindrical granules with lengths of more than 3 mm are subsequently broken to a predetermined length and optionally rounded so that a length of 3 mm is not exceeded. Cylindrical granules preferably have a length of up to 3 mm while preferred spherical and optionally rounded granules have a particle diameter of 1 mm to 2 mm.

EXAMPLES

To produce the granular bleach activators, components (A) to (D), of which (A), (B) and (D) were solid or in powder form and (C) was liquid, were intensively mixed for 1 minute in the ratios shown in the Table in a Lödige plowshare mixer (manufacturer: Lödige, Germany). The particle size of the bleach activators (a) was less than 300 μm (Helos particle size analysis). In the case of (A1), TAED, more than 90% of the particles were below 170 μm in size. The premix thus obtained was then fed continuously to an annular die press (pellet press according to DE 38 16 842, manufacturer: Schlüter, Germany) of which the temperaturecontrolled pressure roller had been heated to 50° C. Slight variations in temperature occurred during the process, the temperature of the pressure roller remaining above 45° C. and below 60° C. The diameter of the bores permeating the annular die was 1 mm to 1.5 mm (see Table). The interval between the pressure roller and the annular die was 1.8 mm to 3 mm (see Table). The strand issuing from the die was cut to a length of 1.5 mm by a knife arranged on the outside. In addition, the granules of Examples 1 and 7 were rounded in a commercially available machine of the Marumerizer type. Since all the products were tack-free, it was not absolutely essential to cover the surface of the granules with a solid, such as zeolite NaA.

The low-dust products 1 to 7 were sieved through 0.6 mm and 1.6 mm mesh sieves. In every case, the fine component of the granules smaller than 0.6 mm in size was at most 2% while the coarse component of the granules larger than 1.6 mm in size was at most 1%. The sieved products had an apparent density of 650 g/l to 820 g/l.

TABLE

| | 1 | 2 | 3 | 4 | 5 | 6 | 7 |
|---|---|---|---|---|---|---|---|
| Composition in % by weight: | | | | | | | |
| (A) Bleach activator | | | | | | | |
| (A1) TAED | 80 | 80 | — | 85 | — | 90 | — |
| (A2) DADHT | — | — | 80 | — | 85 | — | 90 |
| (B) Anionic surfactants | | | | | | | |
| (B1) Sodium dodecylbenzene sulfonate (96%) | 8.0 | 8.5 | 7.5 | 10 | 7 | 8 | 7 |
| (B2) $C_{16-18}$ tallow alcohol sulfate | 4.0 | 5.5 | 4.0 | — | 3 | — | — |
| (B3) $C_{12-18}$ sodium fatty acid soap | — | — | 0.5 | — | — | — | — |
| (C) Nonionic surfactants | | | | | | | |
| (C1) $C_{12-18}$ fatty alcohol · 5 EO | 6.0 | — | 5.0 | — | — | — | 3 |
| (C2) 80% $C_{12-18}$ fatty alcohol · 5 EO | — | 6.0 | — | — | 3 | 2 | — |

TABLE-continued

| | 1 | 2 | 3 | 4 | 5 | 6 | 7 |
|---|---|---|---|---|---|---|---|
| 20% $C_{12-14}$ fatty alcohol · 3 EO | | | | | | | |
| (C3) $C_{12-18}$ fatty alcohol · 7 EO | — | — | 1.0 | 5.0 | 2 | — | — |
| (D) Zeolite NaA | 2.0 | — | 2.0 | — | — | — | — |
| Diameter of the die bores (in mm) | 1.5 | 1.0 | 1.0 | 1.5 | 1.5 | 1.0 | 1.0 |
| Pressue roller/die interval (in mm) | 3.0 | 2.0 | 1.8 | 2.0 | 2.0 | 2.8 | 2.0 |
| Yield of 0.6 mm–1.6 mm granules at least (in %) | 97 | 97 | 97 | 97 | 97 | 97 | 97 |
| Apparent density of granules (in g/l) | 820 | 680 | 650 | 700 | 710 | 750 | 690 |

We claim:

1. A composition comprising free-flowing granules containing from about 70 to about 95% by weight of a bleach activator, based on the weight of said granules, and a substantially water-free binder for said bleach activator, said binder consisting of a mixture of anionic and nonionic surfactants which are solid at storage conditions wherein said anionic surfactant is present in the amount of from about 60 to about 95%/wt., based on the weight of said mixture of anionic and nonionic surfactants, said granules having been prepared by premixing said mixture of surfactants and said bleach activator, homogenizing the resulting mixture to form a paste which is extrudable in strand form, extruding said paste under elevated pressure at a temperature of up to 90° C., cutting the extrudate into granules, and rounding said granules under conditions which prevent said granules from sticking together.

2. A composition prepared as in claim 1 wherein said mixture of surfactants and said bleach activator is substantially anhydrous.

3. A composition prepared as in claim 1 wherein no water is added thereto.

4. A composition prepared as in claim 1 including adding a colorant and from about 0.1 to about 0.5%/wt. of water, based on the weight of said bleach activator, to said mixture of surfactants before premixing it with said bleach activator.

5. A composition prepared as in claim 1 wherein said mixture of surfactants is at least partly liquid at the granulation temperature of said composition.

6. A composition prepared as in claim 1 wherein said mixture of surfactants is partly liquid and partly solid at the granulation temperature of said composition.

7. A composition prepared as in claim 1 wherein said nonionic surfactant comprises a $C_{12}$–$C_{18}$ fatty alcohol ethoxylate having an average ethylene oxide mole content of up to about 10.

8. A composition prepared as in claim 1 having an apparent density of at least about 500 g./l.

9. A composition prepared as in claim 1 wherein said mixture of surfactants and said bleach activator is homogenized and extruded in a pellet press having a pressure roller which is maintained at a predetermined working temperature of up to about 90° C.

10. A composition prepared as in claim 9 wherein said working temperature is from about 45° C. to about 70° C.

11. The process of preparing free-flowing granules containing from about 70 to about 95% by weight of a bleach activator, based on the weight of said granules, and a substantially water-free binder for said bleach activator, said binder consisting of a mixture of anionic and nonionic surfactants which are solid at storage conditions wherein said anionic surfactant is present in the amount of from about 60 to about 95% by weight, based on the weight of said mixture of anionic and nonionic surfactants, said process consisting essentially of premixing said mixture of said anionic and nonionic surfactants and said bleach activator, homogenizing the resulting mixture to form a paste which is extrudable in strand form, extruding said paste under elevated pressure at a temperature of up to 90° C., cutting the extrudate into granules, and rounding said granules under conditions which prevent said granules from sticking together.

12. A process as in claim 11 wherein said mixture of surfactants and said bleach activator is substantially anhydrous.

13. A process as in claim 11 wherein no water is added to said composition.

14. A process as in claim 11 including adding a colorant and from about 0.1 to about 0.5%/wt. of water, based on the weight of said bleach activator, to said mixture of surfactants before premixing it with said bleach activator.

15. A process as in claim 11 wherein said mixture of surfactants is at least partly liquid at the granulation temperature of said composition.

16. A process as in claim 11 wherein said mixture of surfactants is partly liquid and partly solid at the granulation temperature of said composition.

17. A process as in claim 11 wherein said nonionic surfactant comprises a $C_{12}$–$C_{18}$ fatty alcohol ethoxylate having an average ethylene oxide mole content of up to about 10.

18. A process as in claim 11 wherein said granules have an apparent density of at least about 500 g./l.

19. A process as in claim 11 including homogenizing and extruding said mixture of surfactants and said bleach activator in a pellet press having a pressure roller which is maintained at a predetermined working temperature of up to about 90° C.

20. A process as in claim 19 wherein said working temperature is from about 45° C. to about 70° C.

* * * * *